United States Patent [19]

Bauch et al.

[11] Patent Number: 4,808,885

[45] Date of Patent: Feb. 28, 1989

[54] ELECTRIC INCANDESCENT LAMP FOR SERIES ARRANGEMENT HAVING AN ELECTRICALLY CONDUCTIVE VITREOUS BODY CONNECTING OXIDE COATED CURRENT-SUPPLY CONDUCTORS

[75] Inventors: Wolf-Dieter Bauch, Niederzier; Rolf Gervelmeyer, Geilenkirchen; Heinrich B. Merker, Jülich, all of Fed. Rep. of Germany

[73] Assignee: U.S. Philips Corporation, New York, N.Y.

[21] Appl. No.: 63,616

[22] Filed: Jun. 18, 1987

[30] Foreign Application Priority Data

Jun. 18, 1986 [DE] Fed. Rep. of Germany ..... 3620373

[51] Int. Cl.[4] ..... H01K 1/70; H01K 3/08; H01K 1/20

[52] U.S. Cl. ..... 315/122; 315/75; 315/123; 315/185 R; 315/185 S

[58] Field of Search ..... 315/73, 74, 75, 121, 315/122, 123, 125, 127, 185 R, 185 S, 119; 313/315

[56] References Cited

U.S. PATENT DOCUMENTS

| | | | |
|---|---|---|---|
| 1,992,844 | 2/1935 | Severin et al. | 315/75 |
| 3,611,010 | 10/1971 | Strobel | 315/75 |
| 4,233,543 | 11/1980 | Hickok | 315/75 |
| 4,340,841 | 7/1982 | Schupp | 315/75 |

FOREIGN PATENT DOCUMENTS

| | | | |
|---|---|---|---|
| AT82315 | 12/1920 | Fed. Rep. of Germany | 315/75 |
| 839160 | 6/1960 | United Kingdom | 315/75 |
| 1077863 | 3/1965 | United Kingdom | 315/75 |

*Primary Examiner*—David K. Moore
*Assistant Examiner*—Mark R. Powell
*Attorney, Agent, or Firm*—Brian J. Wieghaus

[57] ABSTRACT

The electric lamp for series arrangement comprises at least one current-supply wire of nickel wire, copper wire or copper cladded wire. A shortcircuit switch is provided, which consists of a vitreous mass, in which copper powder is dispersed and which is fused with the current-supply wires, and of an oxide skin, which is present on the said current-supply wire at the sealing-in area in the mass. The vitreous mass is electrically conducting. An electrical connection between the current-supply wires is not obtained, however, until the filament burns through and the oxide skin breaks down due to the overvoltage then occurring.

11 Claims, 1 Drawing Sheet

ELECTRIC INCANDESCENT LAMP FOR SERIES ARRANGEMENT HAVING AN ELECTRICALLY CONDUCTIVE VITREOUS BODY CONNECTING OXIDE COATED CURRENT-SUPPLY CONDUCTORS

BACKGROUND OF THE INVENTION

The invention relates to an electric incandescent lamp for series arrangement comprising a translucent envelope, in which a filament is arranged between current-supply wires, which extend through the wall of the envelope to the exterior, the current-supply wires in this envelope being interconnected in an electrically insulating manner by a supporting member and the lamp comprising a shortcircuit switch, which shunts the filament and comprises a vitreous mass or body, in which metal powder is dispersed. Such a lamp is known from GB PS No. 1,077,863.

In such lamps, the shortcircuit switch must be practically impervious to current at the operating voltage, but must become current-conducting at the overvoltage occurring when the filament burns through during operation of the lamp in series arrangement.

In the incandescent lamp known from GB PS No. 1,077,863, the shortcircuit switch is an element consisting of a sintered mixture of glass powder and iron powder, which is fused or sintered to the currentsupply wires. The mixture may be present in a hollow supporting member, may be constructed itself as a supporting member or may be sintered to the outer side of the lamp envelope. This shortcircuit element interconnecting the current-supply wires first acts as an isolator, but should break down upon application of a high electric voltage and hence should shortcircuit the lamp when the filament burns through. The breakdown which should occur in the case of overvoltage in this shortcircuit element is strongly dependent upon not readily controllable quantities, such as mixture of the powders, grain size distribution, fusion or sintering to the current-supply wires, content of moisture during the manufacture of the lamp, etc. Therefore, a reliable shortcircuit switch cannot be readily manufactured.

According to GB PS No. 1,077,863, a shortcircuit element is used for electric incandescent lamps for series arrangement which consists of copper oxide powder and glass powder. This element is also non-conducting in the normal condition and will become conducting only upon application of overvoltage. It has been found in practice that this switch does not operate in a reliable manner either.

This also applies to an incandescent lamp known from GB PS No. 839,160 comprising a shortcircuit element consisting of a paste of copper powder, magnesium oxide and silicone resin, the quantity of magnesium oxide being 18 to 24% by weight of the quantity of copper. This member is also non-conducting, but will become conducting upon application of an overvoltage.

SUMMARY OF THE INVENTION

The invention has for its object to provide an electric incandescent lamp of the kind mentioned in the opening paragraph comprising a shortcircuit switch which responds very reliably when the filament of the lamp burns through and then shunts the lamp in an electrically conducting manner, while moreover this lamp can be readily manufactured also in mass production.

According to the invention, this object is achieved in the electric incandescent lamp of the kind mentioned in the opening paragraph in that at least one of the current-supply wires is chosen from nickel wire, copper wire and copper cladded wire and the vitreous mass is a fused mass comprising 50 to 70% by weight of glass and 30 to 50% by weight of copper powder dispersed therein which is fused with the current-supply wires, said at least one current-supply wire having at the sealing-in area in the vitreous mass an oxide skin, which breaks down when the filament burns through.

The vitreous mass with the copper powder dispersed therein is electrically conducting already from the beginning because of its high content of copper. In the lamp of the invention, the resistance to direct current passage is produced by the oxide skin present at the sealing-in area on the at least one current-supply wire, whose thickness and hence breakdown voltage can be controlled by the conditions during sealing-in. In this lamp there exist consequently only one parameter, which determines the breakdown voltage. All the remaining known solutions are on the contrary dependent upon several parameters and hence are more strongly jeopardized beforehand and can be controlled with greater difficulty.

It is advantageous that both current-supply wires are chosen from nickel wire, copper wire and copper cladded wire and have an oxide skin at their sealing-in area. The shortcircuit switch then comprises the already initially electrically conducting mass of fused glass and copper powder dispersed therein and the two initially nonconducting oxide films.

The vitreous mass with the copper powder dispersed therein of the incandescent lamp according to the invention may either be applied by fusion to the supporting member holding the current-supply wires, or be constructed as the supporting member interconnecting the current-supply wires in an electrically insulating manner to be fused with the envelope on the outer side of the envelope.

If the mass should be applied by fusion to a supporting member, a mixture of copper powder and glass powder can be pressed to form a ring and be sintered, whereupon the ring is arranged on the supporting member provided with the current-supply wires and applied to it by fusion, until the ring material on the supporting member establishes a connection between the current-supply wires. In a similar manner, the shortcircuit switch can be formed on the outer side of the envelope.

If the mass should itself be constructed as a supporting member for the current-supply wires, a mixture of copper powder and glass powder can be pressed to form a ring and be sintered, after which the ring is provided on the current-supply wires arranged at a certain relative distance and is then fused to form an electrically conducting supporting member.

Advantageously, a glass is chosen which does not soften at the operating temperature of the lamp, but can nevertheless be processed in a simple manner. Glasses having a melting point in the range of 500°–600° C. have proved to be very advantageous.

The oxide skin on a current-supply wire can be produced in a simple manner, for example when it is sealed into the vitreous mass. The thickness of the oxide skin can be controlled in a simple manner by means of a jet of protective gas directed to the sealing-in area. A limited series of tests is already sufficient to determine the conditions for obtaining a desirable breakdown voltage.

BRIEF DESCRIPTION OF THE DRAWINGS

In order that the invention may be readily carried out, it will now be described more fully, by way of example, with reference to the accompanying drawing, in which.

DESCRIPTION OF THE PREFERRED EMBODIMENTS

Figure 1:
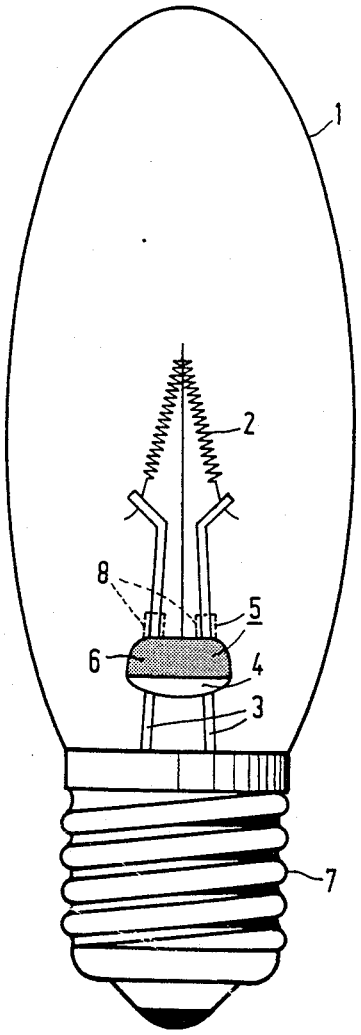
FIG. 1 is a side elevation of a first lamp.
Figure 2:
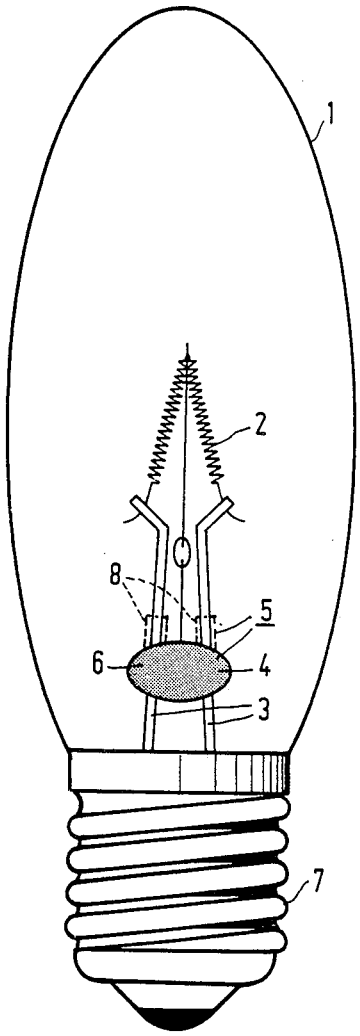
FIG. 2 is a side elevation of a second lamp.

The lamps shown in FIGS. 1 and 2 comprise a translucent envelope 1 of glass, in which a filament 2 is arranged between current-supply wires 3, which extend through the wall of the envelope 1 to the exterior. In the envelope 1 the current-supply wires 3 are interconnected in an electrically insulating manner by means of a supporting member 4. The lamps comprise a shortcircuit switch 5, which shunts the filament 2 and comprises a vitreous mass or body 6 with metal powder dispersed therein. The lamps are each provided with a screw cap 7, which is connected to the current-supply wires 3.

The lamps shown in FIGS. 1 and 2 comprise current-supply wires 3, which are chosen from nickel wire, copper wire and copper cladded wire. The vitreous mass 6 is a fused mass comprising 50 to 70% by weight of glass and 30 to 50% by weight of copper powder dispersed therein and is fused with the current-supply wires 3. The current-supply wires 3 have at their sealing-in area in the vitreous mass 6 an oxide skin 8, which breaks down when the filament 2 burns through.

The vitreous mass 6 in FIG. 1 is a layer present on the supporting member 4; in FIG. 2, the vitreous mass 6 itself constitutes the supporting member 4.

The vitreous mass 6 with the copper powder dispersed therein is electrically conducting already at the beginning of the life of the lamps. In FIG. 1, the mass has a resistance of about 1 Ω. Nevertheless the current-supply wires 3 are interconnected in an electrically insulating manner because the mass 6 terminates at the oxide skin 8 of the wires 3. The mass 6 comprises 60.4% by weight of glass, for example lead borosilicate glass having a melting point of about 550° C., and 39.6% by weight of copper powder, for example powder having a pore size between 8 and 60 um with 90% by weight having a size between 8 and 40 um.

The shortcircuit switch in these lamps consists of the mass 6 and the oxide skin 8. Due to these oxide skins 8, there is an electrically non-conducting connection between the current-supply wires 3 at the beginning of the life of the lamps, but, when the filament 2 burns through during operation of the lamps in series arrangement, the full voltage carried by the series of lamps is applied to the shortcircuit switch 6, 8. The oxide skins 8 break down and the shortcircuit switch 6, 8 becomes electrically conducting.

The thickness of the oxide skins is chosen so that the shortcircuit switch has a breakdown voltage between 50 and 200 V. In the embodiment described, the thickness of the skins amounts to 4 mm.

The lamp according to the invention has proved to be very reliable and can be manufactured in a simple manner.

The mass 6 can be prepared in that 58% by weight of glass powder, 38% by weight of copper powder and 4% by weight of binder, for example, acrylate resin, are mixed and pressed to form rings. For strengthening purposes, the rings may be sintered, for example for 20 seconds at 625°-635° C. During this process and during the process of fusing the rings with the current-supply wires, the binder is decomposed and the decomposition products evaporate. The growth of the oxide skins 8 during the sealing-in processes is limited by a jet of a protective gas, for example nitrogen.

What is claimed is:

1. An incandescent lamp, comprising:

(a) an outer envelope sealed in a gas tight manner;

(b) a pair of metallic current-supply conductors extending through said outer envelope to the exterior, said current-supply conductors being spaced apart over their entire length;

(c) a filament connected to said current-supply conductors; and (d) means for electrically shunting said current-supply conductors when said filament burns through, said means comprising one of said current-supply conductors having an oxide coating over a portion of its length, and a vitreous body fused to said one current-supply conductor at said oxide coating and to the other current-supply conductor, said body being electrically conductive at the voltage applied across said current-supply conductors during lamp operation, and said oxide coating having a thickness such that no current flows between said current-supply conductors through said vitreous body during lamp operation but upon burn-through of said filament said oxide coating breaks down allowing current flow from one current-supply conductor through said vitreous body to the other current-supply conductor.

2. A lamp as claimed in claim 1, wherein said current-supply conductor having said oxide-coating is a wire length chosen from a group consisting of nickel wire, copper wire and copper cladded wire.

3. A lamp as claimed in claim 2, wherein said fused vitreous body comprises 50 to 70% by weight of glass and 30 to 50% by weight of copper powder dispersed therein.

4. A lamp as claimed in claim 1, wherein said fused vitreous body comprises 50 to 70% by weight of glass and 30 to 50% by weight of copper powder dispersed therein.

5. A lamp as claimed in claim 1, wherein both of said current-supply conductors are wire lengths chosen from the group consisting of nickel wire, copper wire and copper cladded wire and said vitreous body comprises 50 to 70% by weight of glass and 30 to 50% by weight of copper powder dispersed therein.

6. A lamp as claimed in claim 1, wherein a supporting member for supporting said current-supply conductors is connected to each of said current-supply conductors and said vitreous body is fused to said supporting member.

7. A lamp as claimed in claim 6, wherein both of said current-supply conductors are wire lengths chosen from the group consisting of nickel wire, copper wire and copper cladded wire and said vitreous body comprises 50 to 70% by weight of glass and 30 to 50% by weight of copper powder dispersed therein.

8. A lamp as claimed in claim 1, wherein said vitreous body is shaped and fused to said current-supply conductors for supporting said current-supply conductors.

9. A lamp as claimed in claim 8, wherein both of said current-supply conductors are wire lengths chosen from the group consisting of nickel wire, copper wire and copper cladded wire and said vitreous body comprises 50 to 70% by weight of glass and 30 to 50% by weight of copper powder dispersed therein.

10. A lamp as claimed in claim 2, wherein said vitreous body is fused to said lamp envelope in the region where said current-supply conductors extend through the lamp envelope to the exterior.

11. A lamp as claimed in claim 10, wherein both of said current-supply conductors are wire lengths chosen from the group consisting of nickel wire, copper wire and copper cladded wire and said vitreous body comprises 50 to 70% by weight of glass and 30 to 50% by weight of copper powder dispersed therein.

* * * * *